United States Patent [19]

Natterer

[11] Patent Number: 4,739,604

[45] Date of Patent: Apr. 26, 1988

[54] PRINTING DEVICE FOR PACKAGING MACHINES

[75] Inventor: Johann Natterer, Legau, Fed. Rep. of Germany

[73] Assignee: Multivac Sepp Haggenmuller KG, Wolfertschwenden, Fed. Rep. of Germany

[21] Appl. No.: 935,588

[22] Filed: Nov. 26, 1986

[30] Foreign Application Priority Data

Dec. 20, 1985 [DE] Fed. Rep. of Germany ..... 3545516

[51] Int. Cl.[4] ..... B65B 61/02; B41F 13/02

[52] U.S. Cl. ..... 53/131; 101/228; 101/329

[58] Field of Search ..... 53/411, 131; 101/219, 101/228, 229, 337, 341, 290, 293

[56] References Cited

U.S. PATENT DOCUMENTS

| | | | |
|---|---|---|---|
| 4,024,816 | 5/1977 | Williams et al. | 101/329 X |
| 4,033,092 | 7/1977 | Vetter | 53/131 X |
| 4,233,801 | 11/1980 | Watt | 53/131 X |
| 4,475,457 | 10/1984 | Davison | 101/228 |
| 4,490,963 | 1/1985 | Knudsen | 53/131 X |
| 4,528,908 | 7/1985 | Davison et al. | 101/295 |
| 4,559,755 | 12/1985 | Romagnoli | 53/131 X |
| 4,559,872 | 12/1985 | Perra, Jr. | 101/329 X |

FOREIGN PATENT DOCUMENTS

| | | |
|---|---|---|
| 2437128 | 2/1976 | Fed. Rep. of Germany . |
| 2943876 | 5/1980 | Fed. Rep. of Germany . |
| 3217176 | 10/1983 | Fed. Rep. of Germany . |
| 3506970 | 9/1985 | Fed. Rep. of Germany . |
| 3318969 | 9/1985 | Fed. Rep. of Germany . |
| 2147854 | 5/1985 | United Kingdom . |

*Primary Examiner*—Horace M. Culver

*Attorney, Agent, or Firm*—Donald Brown; Robert T. Gammons

[57] ABSTRACT

In a packaging machine for packing in packages formed in a material web a printing means having type bars for printing on the material web reciprocally movable between a rest position having a distance from the material web and an operating position, and an inking wheel and drive means for moving the inking means in a direction transversely to the type bars and for applying ink onto the type bars. In order to eliminate the frequent exchange of an ink ribbon the inking wheel is designed such that ink is applied to the type bars only in case the inking wheel is heated to a temperature being above room temperature, and the inking wheel is disposed in a casing which at least partly surrounds the inking wheel and which is designed to be heated and to be moved reciprocally together with the inking wheel.

6 Claims, 3 Drawing Sheets

PRINTING DEVICE FOR PACKAGING MACHINES

BACKGROUND OF THE INVENTION

The invention relates to an improved printing device for a packaging machine and in particular to a packaging machine for packing in packages formed in a material web or sheet material.

In a known packaging machine of this kind an ink ribbon is provided between the type bars and the film to be printed. In the same manner as in a typewriter the ink ribbon is drawn from a supply roll and moved along the type bars. In particular in cases where several type bars are provided which correspond to each other and which are associated to packages arranged side by side it cannot be avoided that a considerably unused portion of the ink ribbon must be pulled through. As a result the ink ribbons have to be exchanged a couple of times a day with the consequence of an interruption of the machine operation each time.

OBJECTS OF THE INVENTION

It is an object of the invention to provide an improved printing device for a packaging machine. It is a further object to design a printing device such that the frequent exchange of the ink ribbon is eliminated.

SUMMARY OF THE INVENTION

In order to achieve the above mentioned objects the invention provides in combination with a packaging machine for packing in packages formed in a material web, printing means having type bars for printing on the material web and being reciprocally movable between a rest position having a distance to the material web and an operating position, an inking wheel and drive means for moving the inking wheel in a direction transverse to the type bars and for applying ink on the type bars, the inking wheel being designed such that ink is applied to the type bars only if the inking wheel is heated to a temperature above room temperature, the inking wheel being disposed in a casing which at least partly surrounds the inking wheel and which is designed to be heated and to be reciprocally moved together with the inking wheel.

BRIEF DESCRIPTION OF THE DRAWINGS

Further advantages, features, and objects of the invention will stand out from the following description of an examplary embodiment with reference to the drawings, wherein.

DESCRIPTION OF THE PREFERRED EMBODIMENT

Figure 1:
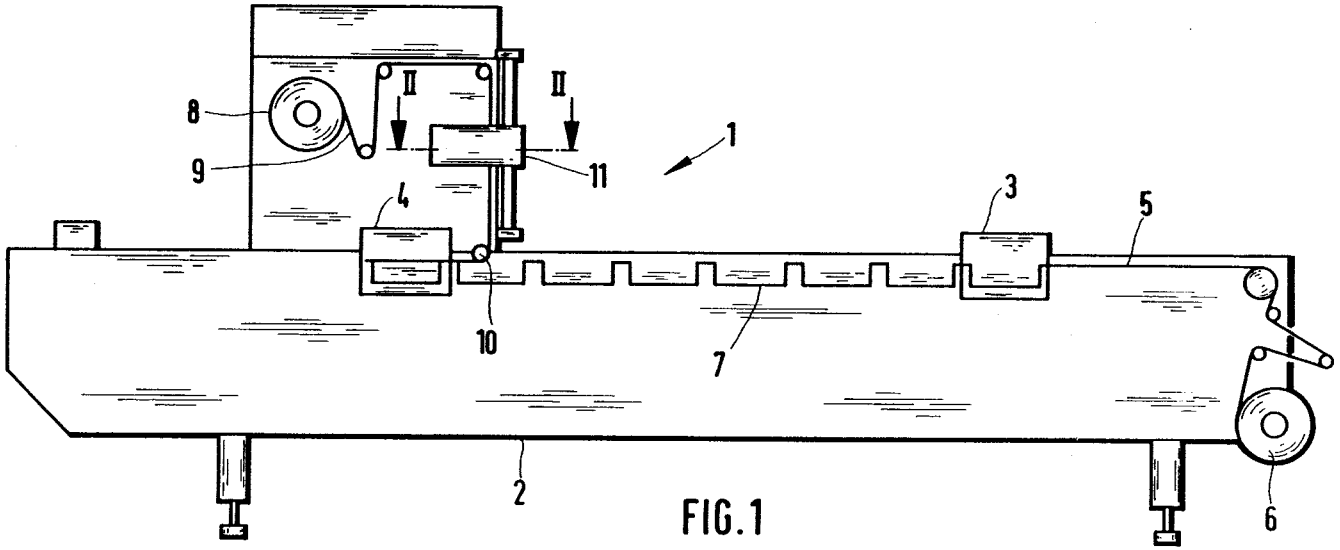
FIG. 1 is a schematic lateral view of the packaging machine with omitted side wall.

The packaging machine 1 comprises a machine frame 2, a forming station 3 and sealing station 4 supported by the machine frame. A bottom film 5 is drawn from a supply roll 6 and intermittently advanced between the operating cycles of the stations 3 and 4. Containers 7 are formed in the forming station 3 and supplied to the sealing station 4 after being filled. A cover film 9 is drawn from a second supply roll 8 and carried on top of the containers 7 via a deflection roller 10 and thereafter into the selaing station 4 for sealing the containers. In accordance with the invention, printing means 11 are provided for the aforesaid printing machine disposed in a position on the way of the cover film from the supply roll 8 to the deflection roller 10 and hence in front of the transport of the cover film into the sealing station 4.

The printing means 11 comprises a frame 12 which is connected with the machine frame 2. The frame 12 carries two guide bars 13, 14 which are disposed in a distance from each other and which extend in a direction perpendicular to the cover film 9 to be passed through the printing means. A cross-beam 15 is disposed parallel to the cover film and movably arranged on the guide bars 13, 14. On the sides thereof facing the cover film the cross-beam supports heating means 16 with type bars 17, 18, 19 attached thereto. The type bars are formed as blocks. They are arranged on the side facing the cover film 9 and aligned parallel to the surface of the cover film and further connected with the heating means 16 in such a manner that they may be heating to a predetermined temperature of preferably between around 130° and 150° C. The lateral distance of the type bars 17, 18, 19 is selected as a function of the size and number of the packages arranged side by side in direction transverse to the feed direction of the machine such that a printing is performed for each row of packages. As may be seen from FIG. 2 the type bars have a distance from each other.

Moreover, an abutment plate 20 is provided in a position parallel to the cover film 9 carried through the printing means on the side which is turned away from the type bars, and parallel to the cover foil 9. During the printing process the cover film contacts the abutment plate by action of the type bars 17, 18, 19.

A drive means 21 is provided which is formed as a piston-cylinder-means. The cylinder of this drive means is rigidly connected with the frame 12. The piston rod is rigidly connected with the cross-beam 15. The drive means is adjusted such that it moves the type bars into the retracted position shown in FIG. 2 and into the printing position, respectively, in which the type bars press the cover film against the abutment 20, above the cross-beam 15 is a reciprocating manner controlled by a control means.

Two further guide bars 22, 23 are disposed in a right angle to the guide bars 13, 14 and parallel to the plane of the cover film 9. The guide bars 22, 23 are laterally supported by the frame 12 and have a casing 24 reciprocally movable arranged thereupon. The casing comprises a base 25 having two horizontal bores provided therein through which the two guide bars 22, 23 extend. The diameter of these bores is selected such that the base slides freely on the guide bars. The base further comprises a vertical central bore with ball bearings 26, 27 at each end of the bore. Moreover, the ends of the chain 36 passing parallel to the direction of the guide bars 22, 23 are rigidly connected with the base 25.

The base has a casing formed as a heating chamber 29 on the top side thereof. The casing has a vertically extending opening 30 on the side facing the type bars only.

The interior of the heating chamber 29 is substantially cylidnrical and has a size such that an inking wheel 31 just fits therein. The inking wheel 31 is supported on a mandrel 32 and consists of foamed material which is saturated with printing ink. The printing ink is designed such that it is solid and not colouring at ambient temperature. The ink softenes when heated to a temperature above the ambient temperature and preferably in the order of 130° to 150° C. and is transferred to the type bars when contacting the same.

The inking wheel is inserted into the vertical bore of the base 25 through an axle extension 34 connected with the mandrel 32 and is supported in the ball bearing 26, 27. A sprocket wheel 35 is fixedly attached to the axle extension on the side thereof opposite to the inking wheel.

The heating chamber 29 is heated to a preselected temperature of preferably about 130° to 150° C. by means of a control unit.

An endless-loop drive chain 36 is provided parallel to the guide bars 22, 23 and carried around two sprocket wheels 37, 38 disposed at opposite sides of the frame 12. The sprocket wheel 38 may be driven by a motor 39. The drive chain is connected with the base in such a manner that during a movement of the drive chain the casing 24 and hence the inking roller 31 is carried along and is reciprocally moved between both side walls of the frame in direction of the arrow 40.

Furthermore a second drive chain 41 is provided and carried by four deflection gear wheels 42–45 which extend parallel to the axis of the inking wheel 31. The second drive chain is aligned such that it engages the gear wheel 35. The second drive chain may be driven by a motor 46.

Figure 2:
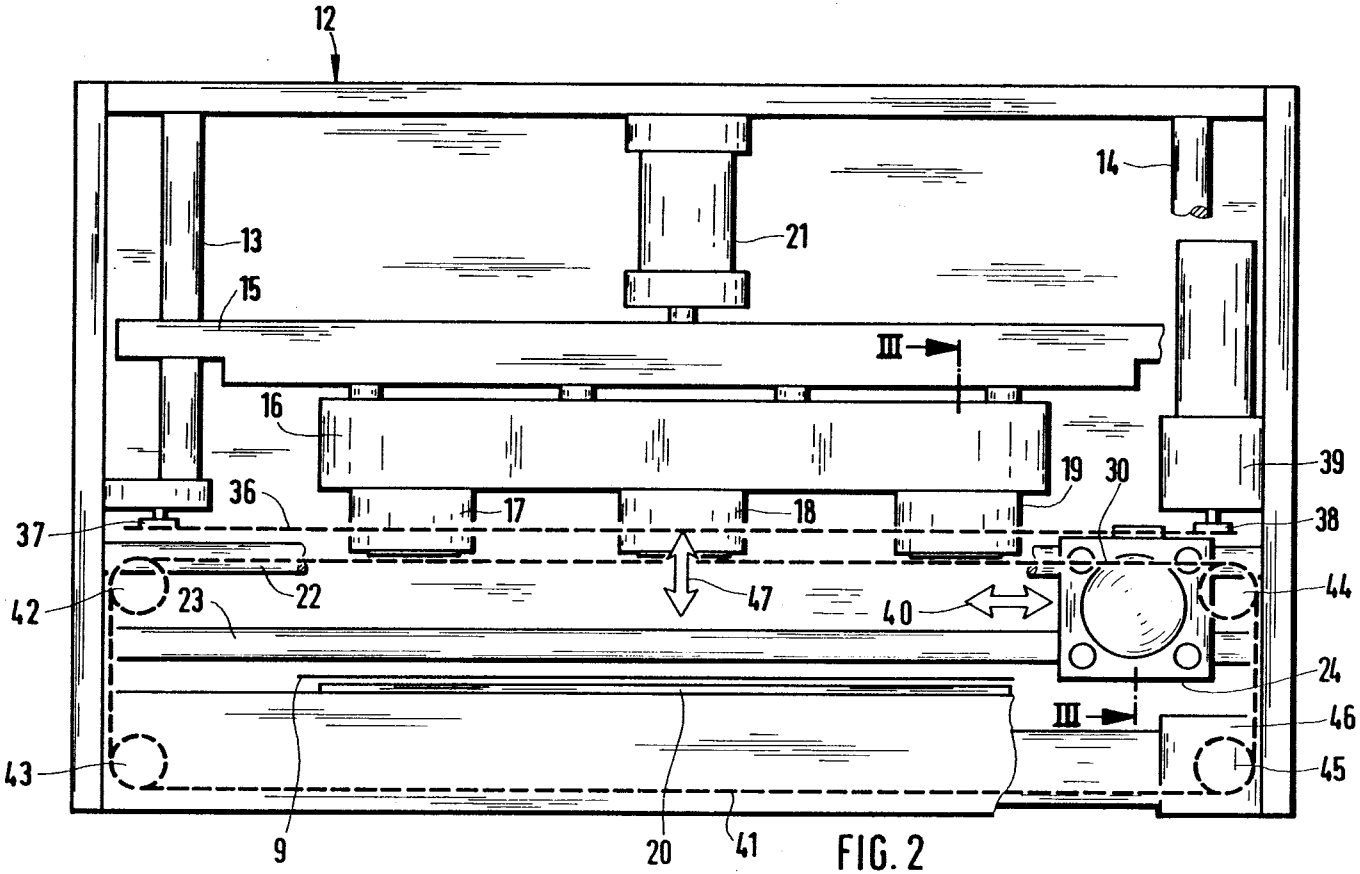
FIG. 2 is a sectional view along line II—II in an enlarged scale.
Figure 3:
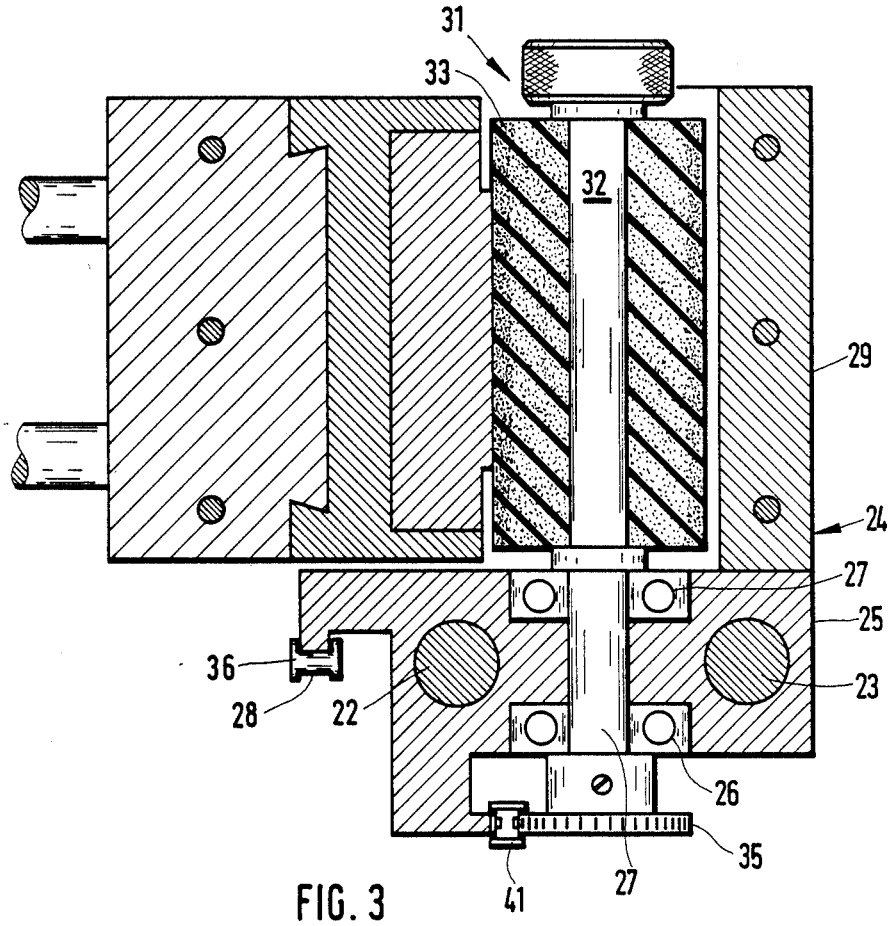
FIG. 3 is a sectional view along line III—III in FIG. 2 in an enlarged scale.

In operation, at first the cover film is passed between the type bars and the abutment plate which is preferably made of elastomer, in the manner shown in FIG. 2.

With the heating switched on the inking wheel is continuously rotated by the motor 46 and the drive chain 41 such that permanently a uniform heating is obtained. For applying the ink to the type bars the motor 46 is switched off and at the same time the motor 38 is switched on. Thus the inking roller is moved along the blocks whereby the inking wheel is permanently rotated by means of the drive chain 41 now acting as rack. The inking wheel rolls over the type bars or type blocks, respectively, and applies the ink thereto. As soon as the inking wheel arrives at the second end position and hence the type bars are coloured, the motor 39 is switched off and the motor 46 is switched on. At the same time the type bars are pressed in direction of the arrow 47 agaisnt the cover film by means of the drive means 21 whereby the ink is transferred to the cover film. Since the cover film is not heated the ink transferred thereto is at one smudge-proof. This is followed by the next cycle.

While the invention has been described in preferred form it is not limited to the precise nature shown as various modifications may be made without departing from the scope of the appended claims.

What is claimed in:

1. In combination with a packaging machine for packing in packages formed in a material web, printing means having type bars for printing on said material web, said type bars being reciprocally movable between a rest position having a distance to said material web and an operating position, an inking wheel and drive means for moving said inking wheel in a direction transverse to said type bars and for applying ink thereupon, said inking wheel being designed such that ink is transferred to said type bars only if said inking wheel is heated to a temperature aboe room temperature, said inking wheel being disposed in a casing which at least partly surrounds said inking wheel and which is designed to be heated and to be reciprocally movable together with said inking wheel.

2. The combination according to claim 1, wherein said casing comprises a mandrel for receiving said inking wheel, said mandrel being rotatably supported in said casing.

3. The combination according to claim 2, comprising means for rotating said inking wheel and a drive means for moving the casing supporting said inking wheel.

4. The combination according to claim 3, wherein said rotating means is designed as a chain cooperating with a gear wheel connected with said mandrel for rotating said inking wheel in rest position of said casing and moving relative to said casing whenever said casing is moving.

5. The combination according to claim 4, wherein said chain is stationary whenever said casing is moving and hence effects a rotation of said inking wheel.

6. The combination according to claim 1 comprising heating means for heating said type bars.

* * * * *